US012669055B2

(12) United States Patent
Wei et al.

(10) Patent No.: US 12,669,055 B2
(45) Date of Patent: Jun. 30, 2026

(54) PERMEABILITY ENHANCEMENT DEVICE FOR COAL-SEAM GAS DRAINAGE

(71) Applicant: Henan Polytechnic University, Jiaozuo (CN)

(72) Inventors: Jianping Wei, Jiaozuo (CN); Yong Liu, Jiaozuo (CN); Tiegang Zhang, Jiaozuo (CN); Heng Yang, Jiaozuo (CN); Hongtu Zhang, Jiaozuo (CN); Xiangyu Xu, Jiaozuo (CN); Boyang Zhang, Jiaozuo (CN); Banghua Yao, Jiaozuo (CN); Peiliang Ren, Jiaozuo (CN); Mian Wang, Jiaozuo (CN); Pan Chen, Jiaozuo (CN); Man Wang, Jiaozuo (CN); Yaocai Tang, Jiaozuo (CN); Xiangyang Wang, Jiaozuo (CN); Jinhua Li, Jiaozuo (CN); Botao Li, Jiaozuo (CN); Changjiang Chen, Jiaozuo (CN); Huidong Zhang, Jiaozuo (CN); Weiyong Lu, Jiaozuo (CN)

(73) Assignee: Henan Polytechnic University, Jiaozuo (CN)

( * ) Notice: Subject to any disclaimer, the term of this patent is extended or adjusted under 35 U.S.C. 154(b) by 0 days.

(21) Appl. No.: 19/288,930

(22) Filed: Aug. 1, 2025

(65) Prior Publication Data

US 2025/0354492 A1 Nov. 20, 2025

Related U.S. Application Data

(63) Continuation of application No. PCT/CN2024/125627, filed on Oct. 18, 2024.

(30) Foreign Application Priority Data

Jan. 17, 2024 (CN) ..... 202410068469.2

(51) Int. Cl.
*E21B 7/18* (2006.01)
*E21B 7/06* (2006.01)
(Continued)

(52) U.S. Cl.
CPC ..... *E21F 7/00* (2013.01); *E21B 7/065* (2013.01); *E21B 7/18* (2013.01); *E21C 41/18* (2013.01)

(58) Field of Classification Search
CPC ..... E21B 7/065; E21B 7/18
See application file for complete search history.

(56) References Cited

U.S. PATENT DOCUMENTS 3,005,507 A * 10/1961 Clark, Jr. ..... E21B 10/18 175/324
4,718,728 A * 1/1988 Hodges ..... E21B 43/29 299/17
6,347,675 B1 2/2002 Kolle
6,920,945 B1 * 7/2005 Belew ..... E21B 7/061 166/298
(Continued)

FOREIGN PATENT DOCUMENTS

CN 201090139 Y 7/2008
CN 104533513 A 4/2015
(Continued)

OTHER PUBLICATIONS

Internation Search Report of PCT/CN2024/125627, Mailed Jan. 25, 2025.

*Primary Examiner* — Sunil Singh

(57) ABSTRACT

A high-efficiency permeability enhancement device for coal-seam gas drainage, wherein, including: a high-pressure gas cylinder, an air compressor being connected to a gas outlet of the high-pressure gas cylinder, a drill pipe, a plurality of jet nozzles being evenly disposed in a circumferential direction of the drill pipe, located below a drill bit, arranged outwards along a radial direction of the drill pipe, and in communication with the gas outlet of the high-pressure gas cylinder; and a plurality of self-driving drill bits being
(Continued)

evenly disposed in the circumferential direction of the drill pipe, and located below the jet nozzles, wherein an end of the drill pipe is provided with the drill bit, a front end of the self-driving drill bits is radially defined with a plurality of front spray holes, and the self-driving drill bits are in communication with the gas outlet of the high-pressure gas cylinder.

5 Claims, 5 Drawing Sheets

(51) Int. Cl.
*E21C 41/18* (2006.01)
*E21F 7/00* (2006.01)

(56) References Cited

U.S. PATENT DOCUMENTS

2009/0173544 A1* 7/2009 Peters ..... E21B 29/06
175/62

FOREIGN PATENT DOCUMENTS

| | | | | |
|---|---|---|---|---|
| CN | 105089500 | A | 11/2015 | |
| CN | 110497320 | A | 11/2019 | |
| CN | 110630181 | A | 12/2019 | |
| CN | 216767274 | U | 6/2022 | |
| CN | 116658196 | A | 8/2023 | |
| CN | 220015181 | U | 11/2023 | |
| CN | 117307039 | A | 12/2023 | |
| WO | WO-0102692 | A1 * | 1/2001 | ..... E21D 9/1066 |
| WO | 2022052288 | A1 | 3/2022 | |

* cited by examiner

PERMEABILITY ENHANCEMENT DEVICE FOR COAL-SEAM GAS DRAINAGE

CROSS-REFERENCE TO RELATED APPLICATIONS

This application is a continuation of International Patent Application No. PCT/CN2024/125627 with a filing date of Oct. 18, 2024, designating the United States, now pending, and further claims priority to Chinese Patent Application No. 202410068469.2 with a filing date of Jan. 17, 2024. The content of the aforementioned applications, including any intervening amendments thereto, are incorporated herein by reference.

TECHNICAL FIELD

The present disclosure relates to the technical field of bottom drainage roadway gas drainage, and in particular to a high-efficiency permeability enhancement device and method for coal-seam gas drainage.

BACKGROUND

Gas drainage is an important technical means for achieving coal-seam gas control. It is an effective means to excavate the bottom drainage roadway to perform a coal-seam pre-drainage in condition permission situation. In practical construction, using a bottom drainage roadway gas drainage drilling construction technology for gas drainage has the characteristics of large engineering quantity, which further increases the gas drainage drilling construction quantity and affects the gas drainage construction period. How to reduce the number of gas drainage drilling holes in the bottom drainage roadway while achieve better gas drainage effect is a bottleneck issue in improving the application level of the bottom drainage roadway gas drainage technology.

Accordingly, there is a need to provide an improved solution to the above-mentioned deficiencies of the prior art.

SUMMARY

It is an object of the present disclosure to provide a high-efficiency permeability enhancement device and method for coal-seam gas drainage to at least solve the above-mentioned problems in the prior art.

In order to achieve the above-mentioned object, the present disclosure provides the following technical solutions:

a high-efficiency permeability enhancement device for coal-seam gas drainage, wherein, including: a high-pressure gas cylinder, an air compressor, a drill pipe, jet nozzles, and self-driving drill bits;

the high-pressure gas cylinder is configured to store a gas medium; and the air compressor is connected to a gas outlet of the high-pressure gas cylinder, and is configured to pressurize the gas medium in the high-pressure gas cylinder; and an end of the drill pipe is provided with a drill bit; and a plurality of the jet nozzles are evenly disposed in a circumferential direction of the drill pipe, and the jet nozzles are located below the drill bit, the jet nozzles are arranged outwards along a radial direction of the drill pipe, and the jet nozzles are in communication with the gas outlet of the high-pressure gas cylinder; and a plurality of the self-driving drill bits are evenly disposed in the circumferential direction of the drill pipe, and the self-driving drill bits are located below the jet nozzles, a front end of the self-driving drill bits is radially defined with a plurality of front spray holes, and the self-driving drill bits are in communication with the gas outlet of the high-pressure gas cylinder.

The high-efficiency permeability enhancement device for coal-seam gas drainage as described above, preferably, the gas outlet of the high-pressure gas cylinder is connected with a jet manifold, and the jet manifold is provided with a jet gas supply valve, which is configured for controlling the on-off of the jet manifold.

The high-efficiency permeability enhancement device for coal-seam gas drainage as described above, preferably, the jet manifold is connected with a plurality of jet branch pipes, each jet branch pipe is correspondingly connected to one jet nozzle, and the air is supplied to the jet nozzles through the jet branch pipes.

The high-efficiency permeability enhancement device for coal-seam gas drainage as described above, preferably, the gas outlet of the high-pressure gas cylinder is connected with a self-driving manifold, the self-driving manifold is provided with a self-driving gas supply valve, which is configured for controlling an on-off of the self-driving manifold.

The high-efficiency permeability enhancement device for coal-seam gas drainage as described above, preferably, the self-driving manifold is connected with a plurality of self-driving branch pipes, each self-driving branch pipe is correspondingly connected to at least one self-driving drill bit, and an air is supplied to the self-driving drill bits through the self-driving branch pipes.

The high-efficiency permeability enhancement device for coal-seam gas drainage as described above, preferably, both the jet branch pipes and the self-driving branch pipes are located inside the drill pipe, and a plurality of the self-driving branch pipes are located at a periphery of a plurality of the jet branch pipes.

The high-efficiency permeability enhancement device for coal-seam gas drainage as described above, preferably, the self-driving drill bits include a high-pressure hose and a nozzle, one end of the high-pressure hose is in communication with the self-driving branch pipes, and an other end of the high-pressure hose is in communication with the nozzle; a plurality of the front spray holes are radially defined at the front end of the nozzle.

The high-efficiency permeability enhancement device for coal-seam gas drainage as described above, preferably, a rear end of the nozzle is defined with a rear spray hole, which is inclined towards the high-pressure hose;

a middle part of the nozzle is defined with a lateral spray hole, which is located between the front spray holes and the rear spray hole, and an orientation of the lateral spray hole is perpendicular to an axis of the nozzle.

The high-efficiency permeability enhancement device for coal-seam gas drainage as described above, preferably, the high-efficiency permeability enhancement device for coal-seam gas drainage further includes a supercritical carbon dioxide generation device, which is in communication with the high-pressure gas cylinder, and is configured to supply a supercritical carbon dioxide gas to the high-pressure gas cylinder.

The present disclosure further provides a high-efficiency permeability enhancement method for coal-seam gas drainage, which is configured to utilize the high-efficiency permeability enhancement device for coal-seam gas drainage as described above, wherein, including steps 1-6:

in the step 1, drilling a large-diameter drill hole from a bottom drainage roadway into a coal-seam as a main drill hole; and in the step 2, after the main drill hole is drilled, withdrawing the drill pipe and a drilling tool from the main drill hole; then inserting the drill pipe in the permeability enhancement device for coal-seam gas drainage into the main drill hole; and in the step 3, after the jet nozzles are reached a coal sighting point, starting the air compressor and opening the jet gas supply valve; injecting the supercritical carbon dioxide gas into a coal body through the jet nozzles; and in the step 4, when the drill pipe is moved up to a half of a coal hole, opening the self-driving gas supply valve and adjusting a pressure parameter of the air compressor to make the self-driving drill bits drill into the coal-seam; and in the step 5, after a drilling process and a slotting process of the self-driving drill bits are completed, closing the self-driving gas supply valve and the jet gas supply valve, and withdrawing the drill pipe from the main drill hole; and in the step 6, sealing the main drill hole, and connecting a gas drainage pipeline for gas drainage.

Advantageous Effects

In the device and method for high-efficiency anti-reflectance for coal-seam gas drainage, one drill hole can be drilled in the bottom drainage roadway as the main drill hole; a high-pressure air or the supercritical carbon dioxide is used to perform an anhydrous pre-slotting on the drill hole coal hole section formed by the main drill hole; meanwhile, an air self-driving drilling is used to realize new drilling construction, and complete a coal-seam slotting based on the new drill hole; multiple times of the slotting and permeability enhancement of the coal-seam are realized, significantly improving the gas drainage effect; meanwhile, a high-pressure gas medium is used to drive or slot in the entire process, reducing the impact of water presence on the gas desorption in the middle of the coal-seam, which can significantly improve the gas drainage effect; and the coal-seam gas drainage is controlled to be concentrated in the main drill hole, such that the construction workload is small, and the gas drainage effect is good.

BRIEF DESCRIPTION OF THE DRAWINGS

The accompanying drawings, which form a part of the present disclosure, are intended to provide a further understanding of the present disclosure, and the schematic embodiment of the present disclosure and the description thereof are intended to explain the present disclosure, and do not constitute an unduly limiting of the present disclosure. Wherein.

LABELS AND DESCRIPTIONS

1—drill bit; 2—jet nozzle; 3—self-driving drill bit; 4—lateral spray hole; 5—drill pipe; 6—jet gas supply valve; 7—self-driving gas supply valve; 8—high-pressure gas cylinder; 9—supercritical carbon dioxide generation device; 10—air compressor; 11—jet branch pipe; 12—self-driving branch pipe; 13—high-pressure hose; 14—rear spray hole; 15—nozzle; 16—front spray hole.

DETAILED DESCRIPTION OF THE EMBODIMENTS

Figure 1:
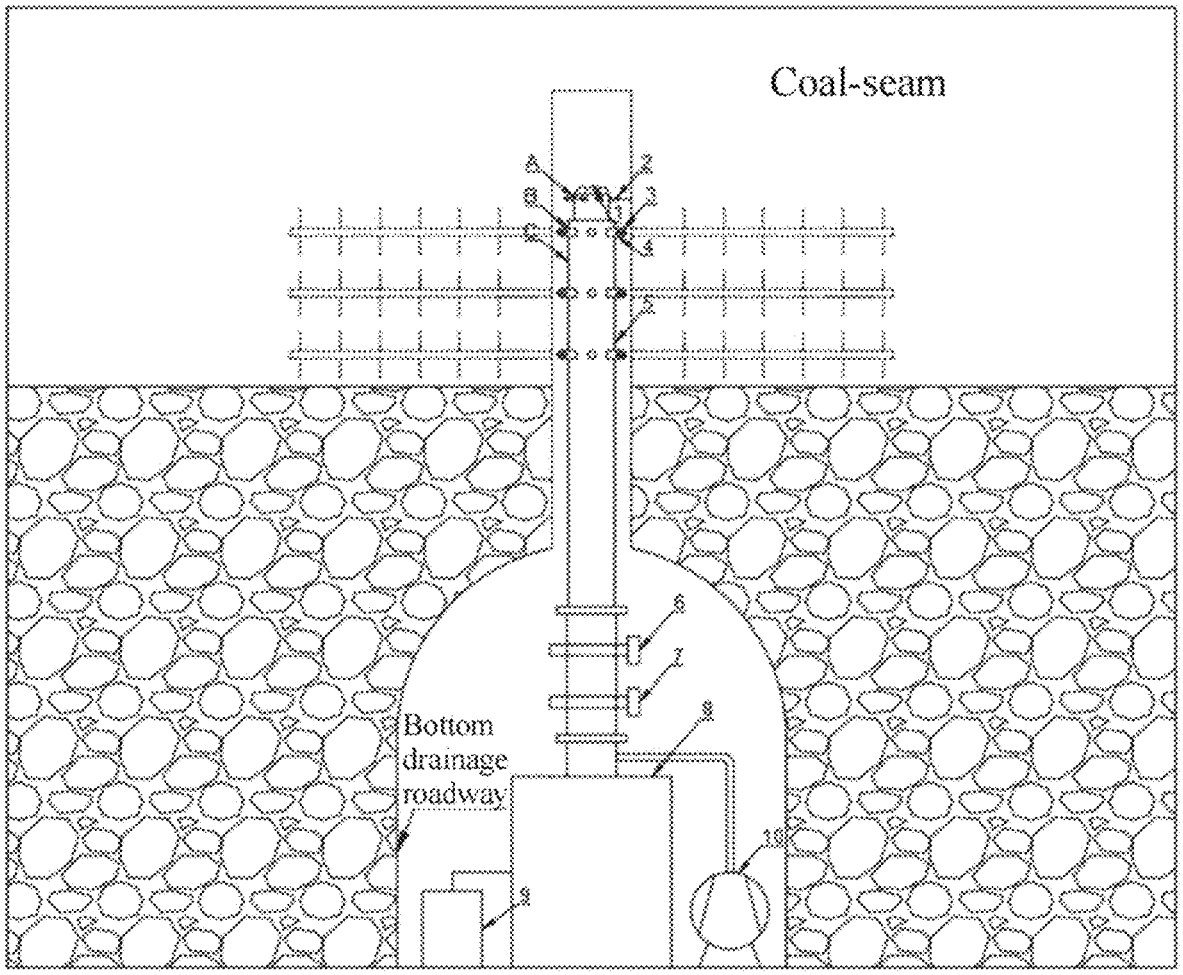
FIG. 1 is a structure schematic diagram of a high-efficiency permeability enhancement device for coal-seam gas drainage according to an embodiment of the present disclosure.
Figure 2:
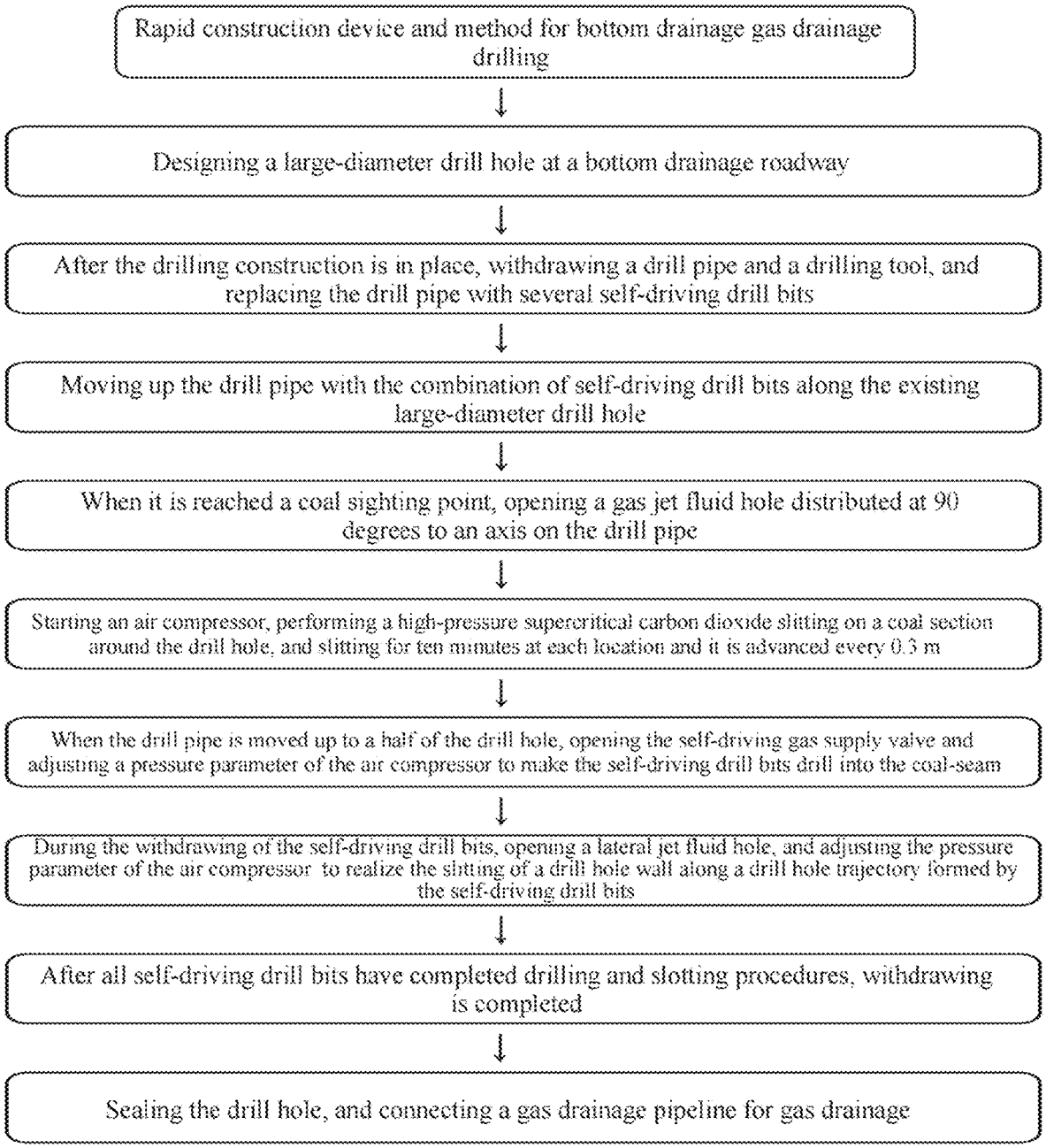
FIG. 2 is a flowchart of a high-efficiency permeability enhancement method for coal-seam gas drainage according to an embodiment of the present disclosure.
Figure 3:
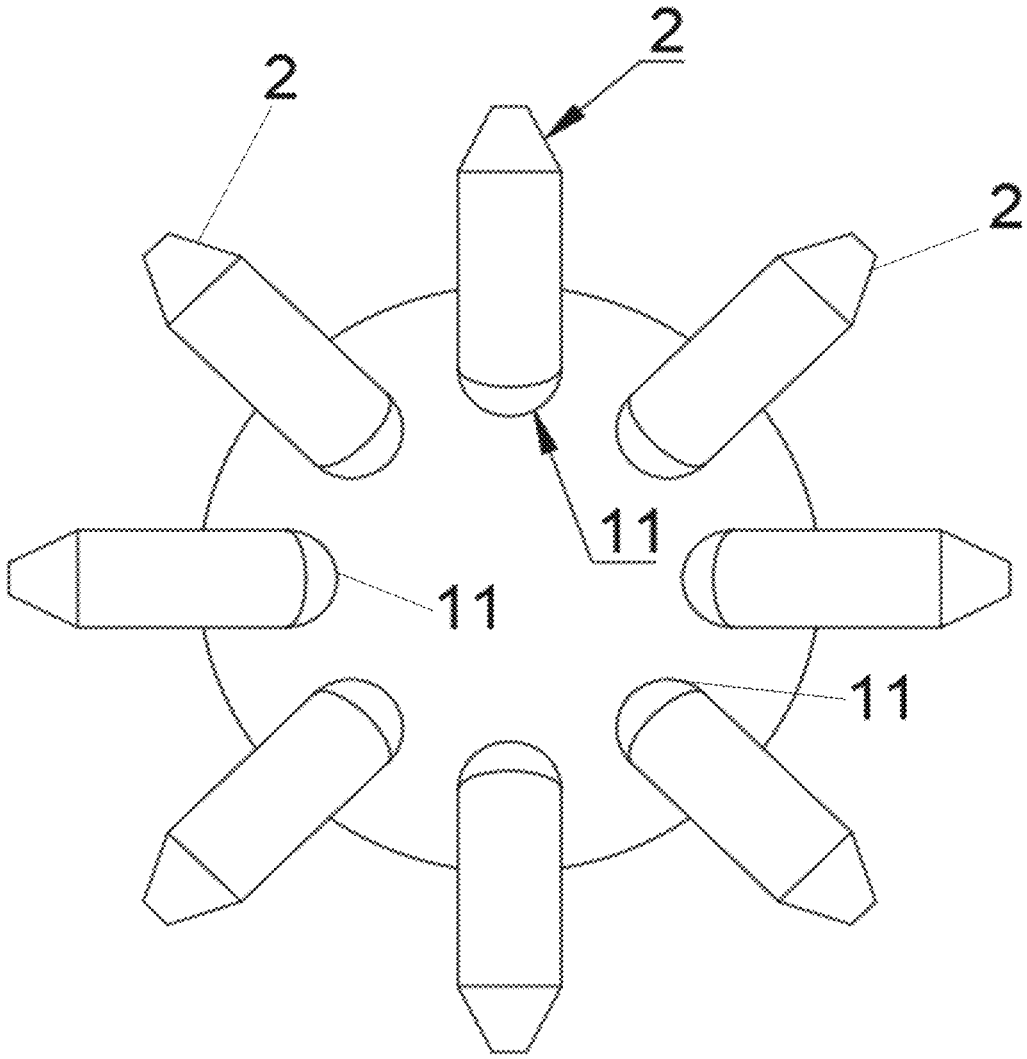
FIG. 3 is a cross-sectional view at point A in FIG. 1 according to an embodiment of the present disclosure.
Figure 4:
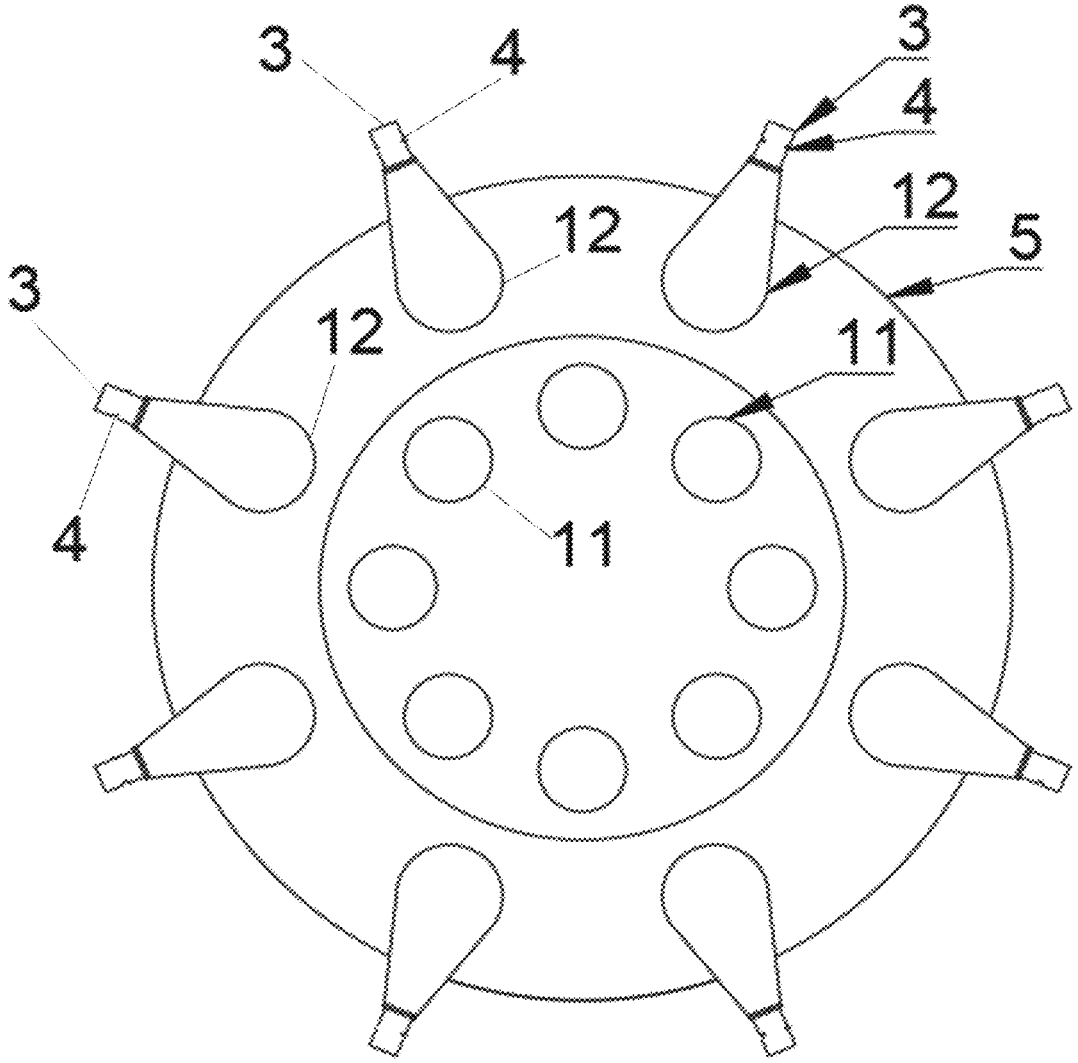
FIG. 4 is a cross-sectional view at point B in FIG. 1 according to an embodiment of the present disclosure.
Figure 5:
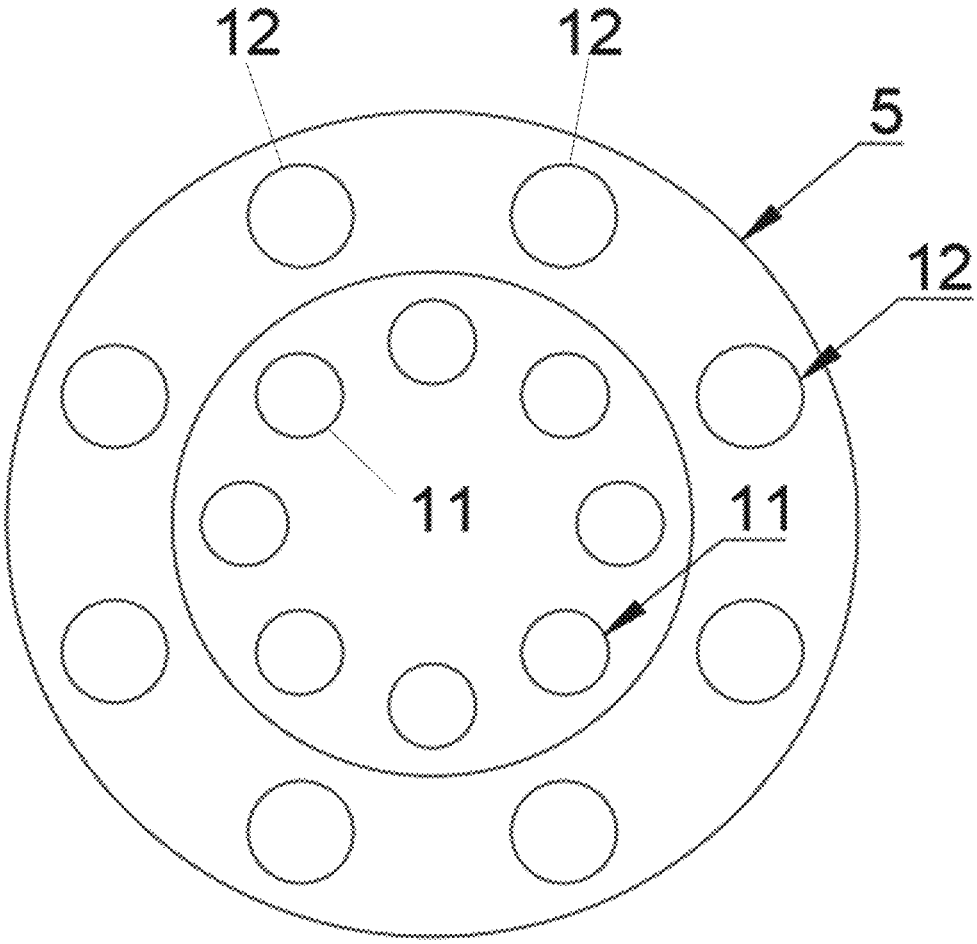
FIG. 5 is a cross-sectional view at point C in FIG. 1 according to an embodiment of the present disclosure.
Figure 6:
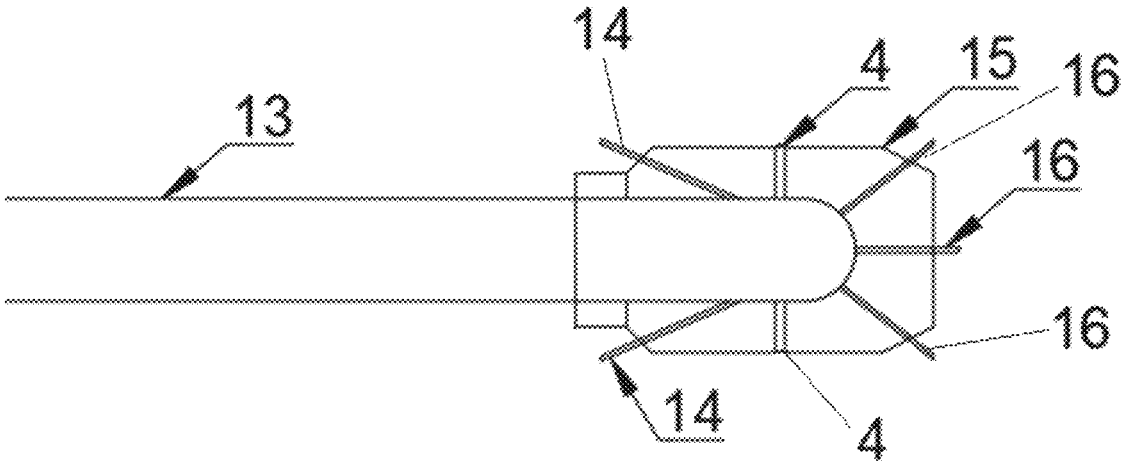
FIG. 6 is a structure schematic diagram of self-driving drill bits according to an embodiment of the present disclosure.

According to a specific embodiment of the present disclosure, as shown in FIGS. 1-6, the present disclosure provides a high-efficiency permeability enhancement device for coal-seam gas drainage, which includes: a high-pressure gas cylinder 8, an air compressor 10, a drill pipe 5, jet nozzles 2, and self-driving drill bits 3.

The high-pressure gas cylinder 8 is used to store a gas medium.

The air compressor 10 is connected to a gas outlet of the high-pressure gas cylinder 8, and is used to pressurize the gas medium in the high-pressure gas cylinder 8.

An end of the drill pipe 5 is provided with a drill bit 1.

A plurality of the jet nozzles 2 are evenly disposed in a circumferential direction of the drill pipe 5, and the jet nozzles 2 are located below the drill bit 1, the jet nozzles 2 are arranged outwards along a radial direction of the drill pipe 5, and the jet nozzles 2 are in communication with the gas outlet of the high-pressure gas cylinder 8.

A plurality of the self-driving drill bits 3 are evenly disposed in the circumferential direction of the drill pipe 5, and the self-driving drill bits 3 are located below the jet nozzles 2, a front end of the self-driving drill bits 3 is radially defined with a plurality of front spray holes 16, and the self-driving drill bits 3 are in communication with the gas outlet of the high-pressure gas cylinder 8.

One drill hole is drilled in the bottom drainage roadway, the drill pipe 5 of this device is extended into the main drill hole, and a high-pressure air is sprayed onto a coal body through the jet nozzles 2 on the drill pipe 5, so as to perform an anhydrous pre-slotting on the coal body. On this basis, a front spray hole 16 is arranged at the front end of the self-driving drill bits 3 to continue spraying the high-pressure air onto the coal body, enabling the self-driving drill bits 3 to drill in a radial direction perpendicular to the main drill hole. Consequently, the coal body is enhanced in permeability circumferentially around the main drill hole, achieving a better permeability enhancement effect on the coal body; this not only reduces the amount of drilling construction workload but also maximizes the gas drainage efficiency.

The gas outlet of the high-pressure gas cylinder 8 is connected with a jet manifold, and the jet manifold is provided with a jet gas supply valve 6, which is used for controlling the on-off of the jet manifold.

The jet manifold is connected with a plurality of jet branch pipes 11, each jet branch pipe 11 is correspondingly connected to one jet nozzle 2, and the air is supplied to the jet nozzles 2 through the jet branch pipes.

In the embodiment of the present disclosure, eight jet nozzles 2 are provided, and eight jet branch pipes 11 are similarly provided, each jet branch pipe 11 is connected to one jet nozzle 2. Wherein, the direction of an airflow sprayed from the jet nozzles 2 is perpendicular to an axial direction of the drill pipe 5.

The gas outlet of the high-pressure gas cylinder 8 is connected with a self-driving manifold, the self-driving manifold is provided with a self-driving gas supply valve 7, which is used for controlling an on-off of the self-driving manifold.

In the embodiment of the present disclosure, the jet manifold and the self-driving manifold are two gas supply branches on the gas outlet of the high-pressure gas cylinder 8. By providing the jet gas supply valve 6 on the jet manifold, and providing the self-driving gas supply valve 7 on the self-driving manifold, two gas supply branches can be used independently without affecting each other.

The self-driving manifold is connected with a plurality of self-driving branch pipes 12, each self-driving branch pipe 12 is correspondingly connected to at least one self-driving drill bit 3, and the air is supplied to the self-driving drill bits 3 through the self-driving branch pipes 12.

In the embodiment of the present disclosure, the drill pipe 5 is provided with three layers of the self-driving drill bits 3, with eight self-driving drill bits 3 in each layer. Eight self-driving branch pipes 12 are provided, and each self-driving branch pipe 12 is connected to three self-driving drill bits 3 in the same axial direction, that is, the air is supplied to three self-driving drill holes through each self-driving branch pipe 12.

Both the jet branch pipes and the self-driving branch pipes are located inside the drill pipe 5, and a plurality of the self-driving branch pipes are located at a periphery of a plurality of the jet branch pipes. In the embodiment of the present disclosure, eight self-driving branch pipes are located around eight jet branch pipes, so as to achieve a more reasonable layout of the pipelines inside the drill pipe 5.

The self-driving drill bits 3 include a high-pressure hose 13 and a nozzle 15, one end of the high-pressure hose 13 is in communication with the self-driving branch pipes, and an other end of the high-pressure hose 13 is in communication with the nozzle 15; a plurality of the front spray holes 16 are radially defined at the front end of the nozzle 15.

In the embodiment of the present disclosure, the high-pressure hose 13 can facilitate the free expansion and contraction of the nozzle 15, allowing the nozzle 15 to approach the coal body closely, which further enables the high-pressure gas sprayed from the nozzle 15 to closely approach the coal and break it, greatly improving the coal breaking effect and facilitating the formation of pores in the coal body by the self-driving drill bits 3; a plurality of the front spray holes 16 are radially outwardly defined, so that the high-pressure gas sprayed from the nozzle 15 can exceed the cross-sectional area of the nozzle 15, which further enable the pores formed by the coal breaking of the self-driving drill bits 3 to have a diameter larger than the diameter of the nozzle 15, thereby further facilitating the nozzle 15 to insert into the pores for coal breaking.

A rear end of the nozzle 15 is defined with a rear spray hole 14, which is inclined towards the high-pressure hose 13; and a middle part of the nozzle 15 is defined with a lateral spray hole 4, which is located between the front spray holes 16 and the rear spray hole 14, and an orientation of the lateral spray hole 4 is perpendicular to an axis of the nozzle 15.

In the embodiment of the present disclosure, the rear spray hole 14 is inclined towards the high-pressure hose 13, that is, the rear spray hole 14 is inclined towards the rear of the nozzle 15. With this arrangement, when the nozzle 15 is entered into the pores formed by the the self-driving drill bits 3, the front spray hole 16 can break the coal to produce the coal dust. During the advance of the nozzle 15, the rear spray hole 14 can blow the air towards the rear to blow out as much coal dust as possible from the pores, thus aporesing the blockage of the pores; while the lateral spray holes 4 can emit the high-pressure gas along the direction perpendicular to the pore extension, forming the fractures perpendicular to the pores in the pores, which can greatly increase the permeability of the coal body.

The permeability enhancement device for coal-seam gas drainage further includes a supercritical carbon dioxide generation device 9, which is in communication with the high-pressure gas cylinder 8, and is used to supply a supercritical carbon dioxide gas to the high-pressure gas cylinder 8.

In the embodiment of the present disclosure, the supercritical carbon dioxide jet has a deep rock-breaking depth and a wide crushing range. Moreover, the threshold pressure for rock-breaking by the supercritical carbon dioxide jet is lower than that of the water jet, achieving better rock-breaking effect. Additionally, it can significantly conserve water resources.

The present disclosure further provides a permeability enhancement method for coal-seam gas drainage, which utilizes the permeability enhancement device for coal-seam gas drainage as described above, wherein, including the following steps 1-6.

In the step 1, drilling a large-diameter drill hole from a bottom drainage roadway into a coal-seam as a main drill hole.

In the step 2, after the main drill hole is drilled, withdrawing the drill pipe 5 and a drilling tool from the main drill hole; then inserting the drill pipe 5 in the permeability enhancement device for coal-seam gas drainage into the main drill hole.

In the step 3, after the jet nozzles 2 are reached a coal sighting point, starting the air compressor 10 and opening the jet gas supply valve 6; injecting the supercritical carbon dioxide gas into a coal body through the jet nozzles 2; slitting the coal body to achieve preliminary permeability enhancement, which provides a good foundation for the subsequent drilling of the self-driving drill bits 3; in the embodiment of the present disclosure, the slit is cut for ten minutes at each location and advanced every 0. 3 m.

In the step 4, when the drill pipe 5 is moved up to a half of a coal hole, opening the self-driving gas supply valve 7 and adjusting a pressure parameter of the air compressor 10 to make the self-driving drill bits 3 drill into the coal-seam.

In the embodiment of the present disclosure, when the high-pressure gas medium is introduced into the self-driving drill bits 3, the high-pressure hose 13 is extended straight forward, allowing the nozzle 15 to press against the coal-seam, and the front spray hole 16 on the nozzle 15 sprays the supercritical carbon dioxide to break the coal and form pores, enabling the nozzle 15 to insert into the pores, at this point, the rear spray hole 14 sprays the gas to spray the coal dust from the pores, and the lateral spray hole 4 sprays the high-pressure gas along the extension direction perpendicular to the pore extension, forming the fractures that is perpendicular to the pores within the pores.

In the step 5, after a drilling process and a slotting process of the self-driving drill bits 3 are completed, closing the self-driving gas supply valve 7 and the jet gas supply valve 6, and withdrawing the drill pipe 5 from the main drill hole.

In the step 6, sealing the main drill hole, and connecting a gas drainage pipeline for gas drainage.

What is claimed is:

1. A permeability enhancement device for coal-seam gas drainage, comprising: a drill rod a high-pressure gas cylinder, configured to store a gas medium;

an air compressor, connected to a gas outlet of the high-pressure gas cylinder and configured to pressurize the gas medium in the high-pressure gas cylinder;

the drill rod, wherein there is disposed a drill bit at an end of the drill rod;

a plurality of jet nozzles, evenly disposed in a circumference of the drill rod, wherein the plurality of jet nozzles are disposed below the drill bit and are oriented radially outwards from the drill rod, and wherein the plurality of jet nozzles are each in communication with the gas outlet of the high-pressure gas cylinder; and a plurality of self-driving drill bits, evenly disposed in the circumference of the drill rod, wherein the plurality of self-driving drill bits are disposed below the plurality of jet nozzles, wherein a front end of each of the plurality of self-driving drill bits radially defines a plurality of front spray holes, and wherein the plurality of self-driving drill bits are each in communication with the gas outlet of the high-pressure gas cylinder;

wherein the gas outlet of the high-pressure gas cylinder is connected with a self-driving manifold, wherein the self-driving manifold comprises a self-driving gas supply valve disposed therein and configured for controlling on-off of the self-driving manifold;

wherein the self-driving manifold is connected with a plurality of self-driving branch pipes, wherein each of the plurality of self-driving branch pipes is correspondingly connected to at least one self-driving drill bit, and wherein the gas medium is supplied to the at least one self-driving drill bit through the corresponding self-driving branch pipe; and wherein each of the plurality of self-driving drill bits comprises a high-pressure hose and a nozzle, wherein one end of the high-pressure hose is in communication with a corresponding self-driving branch pipe, and wherein another end of the high-pressure hose is in communication with the nozzle; wherein the plurality of front spray holes defined in each of the plurality of self-driving drill bits are radially defined at a front end of the nozzle of the self-driving drill bit;

wherein the gas outlet of the high-pressure gas cylinder is connected with a jet manifold, and the jet manifold comprises a jet gas supply valve that is disposed therein and that is configured for controlling the on-off of the jet manifold.

2. The permeability enhancement device for coal-seam gas drainage according to claim 1, wherein the jet manifold is connected with a plurality of jet branch pipes, wherein each jet branch pipe is correspondingly connected to a corresponding jet nozzle, and wherein the gas medium is supplied to each jet nozzle through a corresponding jet branch pipe.

3. The permeability enhancement device for coal-seam gas drainage according to claim 2, wherein both the plurality of jet branch pipes and the plurality of self-driving branch pipes are disposed inside the drill rod, and wherein the plurality of self-driving branch pipes are located at a periphery of the plurality of jet branch pipes.

4. The permeability enhancement device for coal-seam gas drainage according to claim 1, wherein a rear end of the nozzle defines at least one rear spray hole, which is inclined towards the high-pressure hose; and a middle part of the nozzle defines at least one lateral spray hole, which is located between the plurality of front spray holes and the at least one rear spray hole, and wherein an orientation of the lateral spray hole is perpendicular to an axis of the nozzle.

5. The permeability enhancement device for coal-seam gas drainage according to claim 4, wherein, further comprising a supercritical carbon dioxide generation device, which is in communication with the high-pressure gas cylinder and is configured to supply a supercritical carbon dioxide gas to the high-pressure gas cylinder, the supercritical carbon dioxide gas being said gas medium.

* * * * *